US006200173B1

(12) United States Patent
Frisby

(10) Patent No.: US 6,200,173 B1
(45) Date of Patent: Mar. 13, 2001

(54) TERMINAL CLAMP FOR A BATTERY TERMINAL POST

(75) Inventor: Reginald Alan Frisby, Stoke on Trent (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/319,663

(22) PCT Filed: Dec. 19, 1997

(86) PCT No.: PCT/GB97/03495

§ 371 Date: Jul. 29, 1999

§ 102(e) Date: Jul. 29, 1999

(87) PCT Pub. No.: WO98/28820

PCT Pub. Date: Jul. 2, 1998

(30) Foreign Application Priority Data

Dec. 21, 1996 (GB) ..... 9626641

(51) Int. Cl.[7] ..... H01R 4/42
(52) U.S. Cl. ..... 439/762
(58) Field of Search ..... 439/762, 770, 439/765, 757, 758, 754, 755

(56) References Cited

U.S. PATENT DOCUMENTS 3,678,449 7/1972 Jones .
5,087,214 * 2/1992 Dewar ..... 439/762
5,088,941 * 2/1992 Nolle ..... 439/762
5,290,646 * 3/1994 Asao et al. ..... 439/762

FOREIGN PATENT DOCUMENTS 30 10 017 3/1980 (DE) .
0 582 854 7/1993 (EP) .
2 287 587 9/1995 (GB) .

* cited by examiner

*Primary Examiner*—Neil Abrams
*Assistant Examiner*—Javaid Nasri
(74) *Attorney, Agent, or Firm*—Wells, St. John, Roberts, Gregory & Matkin, P.S.

(57) ABSTRACT

A terminal clamp for a battery terminal post including first and second relatively movable jaws defining between them a passage for receiving a battery terminal post, and a screw-operated clamping arrangement for closing the first and second jaws about the terminal post, in use, to grip the post against the action of a resilient restoring force urging the jaws apart, the screw-operated clamping arrangement including first and second components in screw-threaded arrangement with one another, the first component being held against rotation relative to the jaws, the second component having a frusto-conical cam surface cooperable with corresponding part frusto-conical cam surfaces of the jaws, whereby rotation of the second component relative to the first component and the jaws causes rotational and axial movement of the frusto-conical cam surface of the second component relative to the part frusto-conical surfaces of the jaws either to close the jaws or to release the jaws.

7 Claims, 1 Drawing Sheet

TERMINAL CLAMP FOR A BATTERY TERMINAL POST

BACKGROUND OF THE INVENTION

The present invention relates to a terminal clamp for connecting an electrical cable to a terminal post of a vehicle battery.

U.S. Pat. No. 5,088,941, German Patent No. 3811629 and UK Patent Application No. 2287587 each disclose a screw-operated battery terminal clamp comprising a pair of jaws defining between them a passage for receiving a battery terminal post, and screw-operated clamping means for closing the jaws against a resilient restoring force, in use, to grip the post. In each case, the clamping means includes an inclined generally rectilinear cam surface on each jaw and cooperating inclined rectilinear cam surfaces on a component movable relative to the jaws by the screw action, either in a direction to cause the cam surfaces to coact to close the jaws about the terminal post in use, or to release the jaws to open under said resilient restoring force.

A problem encountered with such arrangements is that after being operated to hold the jaws closed, the cam surfaces may bind together so that release of the screw action is ineffective to release the jaws. It is an object of the present invention to provide a terminal post clamp wherein this problem is obviated.

SUMMARY OF THE INVENTION

According to the present invention, there is provided a terminal clamp for a battery terminal post comprising first and second relatively movable jaws defining between them a passage for receiving a battery terminal post, and a screw-operated clamping arrangement for closing said first and second jaws about the terminal post, in use, to grip the post against the action of a resilient restoring force urging the jaws apart, said screw-operated clamping arrangement including first and second components in screw-threaded arrangement with one another, said first component being held against rotation relative to said jaws, said second component having a cam surface cooperable with corresponding cam surfaces of said jaws, said cam surfaces being surfaces of revolution, or parts thereof, centred on the axis of said screw-threaded arrangement whereby rotation of said second component relative to said first component and said jaws causes rotational and axial movement of said cam surface of the second component relative to said cam surfaces of said jaws either to close the jaws or to release the jaws.

It will be recognised that as the cam surfaces are forced to rotate relative to one another while moving axially to effect clamping or release, then the cam surfaces cannot bind together to frustrate release of the jaws in response to a corresponding rotation of said second component.

Preferably said cam surfaces are frusto-conical.

Desirably said first component comprises a captive bolt.

Desirably said second component comprises a nut in threaded engagement with the shank of said bolt.

Preferably said jaws are united at one end and carry said cam surfaces adjacent their opposite ends, said post receiving recess being defined intermediate said cam surfaces and said one end.

Preferably a conductive lead is electrically connected to said jaws adjacent their united end.

BRIEF DESCRIPTION OF THE DRAWINGS

The invention will be further described, by way of example, with reference to the accompanying drawings in which.

DETAILED DESCRIPTON OF THE PREFERRED EMBODIMENT

Figure 1:
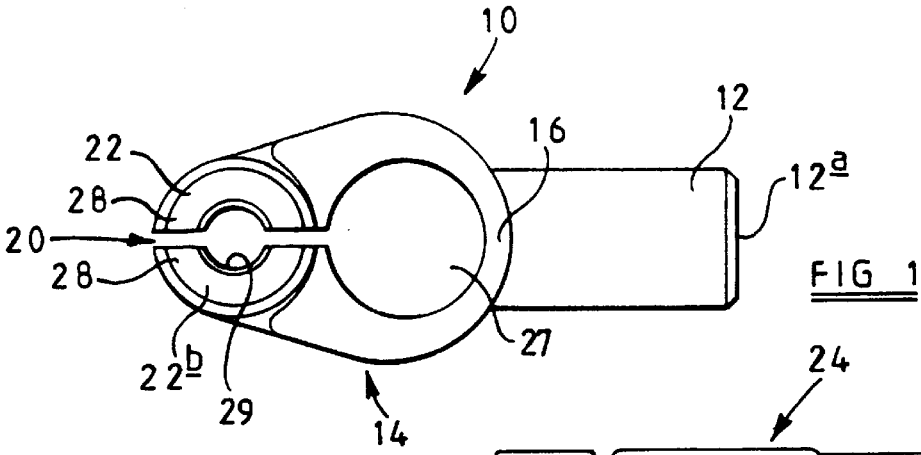
FIG. 1 is a plan view of a terminal clamp for use on a battery terminal post according to one example of the present invention, with part of the clamping mechanism omitted.
Figure 2:
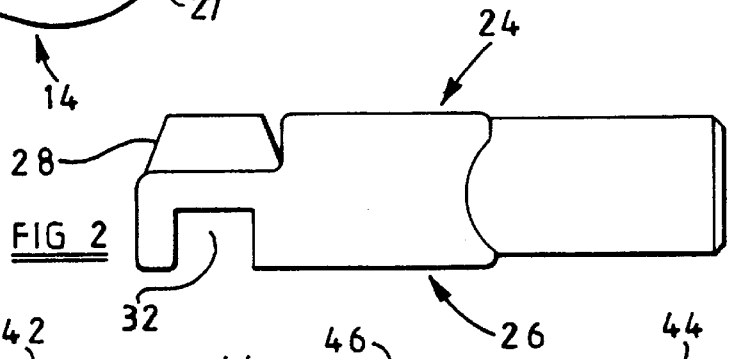
FIG. 2 is a side view of the terminal clamp shown in FIG. 1.

Referring now to FIGS. 1 and 2, the terminal clamp 10 comprises a first hollow cylindrical end region 12 open at its free end 12*a*. Integrally connected to said cylindrical end region 12, remote from the end 12*a*, are first and second clamping jaws 14 united with the region 12 by an end region 16. The jaws 14 are mirror images and are spaced apart by a gap 20 which extends continuously from the common first end region 16 to a free second end region 22 of each jaw 14. The clamp has a first face 24, uppermost in use, and an opposite second face 26. A terminal post (not shown) which the terminal clamp 10 is to engage is frusto-conical having a small taper angle. Adjacent the end region 16 of the clamp 10, the jaws 14 define between them a correspondingly frusto-conical passage 27 extending through the clamp 10 with the larger diameter end of the passage 27 at the face 26 of the clamp 10. Adjacent the end regions 22 of the jaws 14, the jaws define between them a cylindrical passage 29 having its axis parallel to that of the passage 27 and opening at the faces 24 and 26 respectively. Intermediate the free ends of the jaws and the passage 27 the upper surface 24 is cut away or otherwise shaped to define an upwardly extending frustum of a cone coaxial with the passage 29 and divided by the gap 20. The frustum has a cone angle of around 60° and it can be seen that each jaw thus carries a respective upstanding part frusto-conical surface 28. A locating recess 32 is formed in the face 26 of each of said jaws 14, opposite said frustum.

Figure 3A:
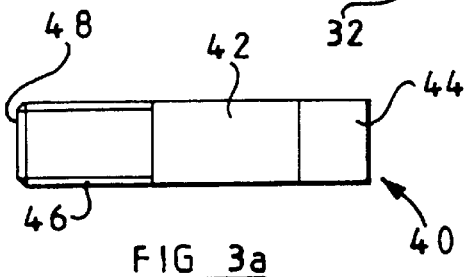
FIGS. 3*a* and 3*b* are side views of a screw-threaded bolt suitable for use with the terminal clamp of FIG. 1.
Figure 3B:
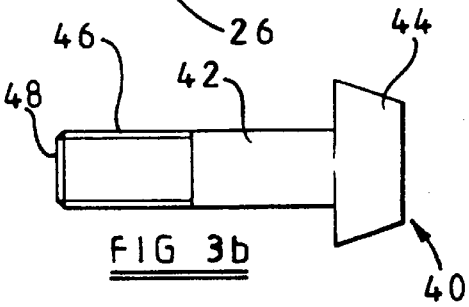

Referring now to FIGS. 3*a* and 3*b*, bolt 40 comprises a cylindrical shank 42, one end of which is integrally formed with a head in the form of a cross piece 44. Said cross piece 44 has a substantially rectangular cross section as viewed in FIG. 3*a*, and a trapezoidal cross-section as viewed in FIG. 3*b*. The cylindrical shank 42 has a diameter less than that of passage 29 (FIG. 1) to permit the jaws to close without restriction. The width of cross piece 44 is slightly less than that of the locating recess 32 (FIG. 2). The cylindrical shank 42 has a screw-threaded region 46 extending from a free second end 48 of shank 42 towards said cross piece 44.

Figure 4:
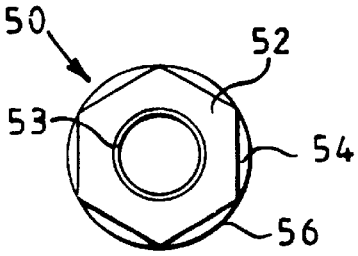
FIG. 4 is a plan view of a threaded nut for use with the bolt of FIG. 3.
Figure 5:
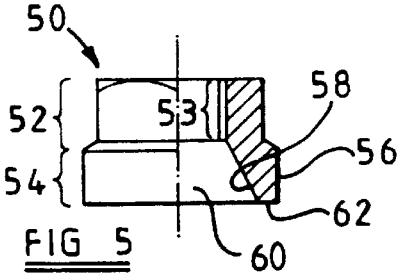
FIG. 5 is a side view of the screw-threaded nut of FIG. 4, shown partially in section.

Referring now to FIGS. 4 and 5, nut 50 comprises a hexagonal nut 52 having a screw-threaded bore 53 designed to mate with the screw-threaded region 46 of bolt 40 (FIGS. 3*a* and 3*b*) and an integrally formed skirt 54. Said skirt has a cylindrical outer surface 56, an inner surface 58 which defines a frusto-conical recess 60 the cone angle of which corresponds with that of the frustum defining the surfaces 28 and which flares outwardly from the screw-threaded bore 53, and an annular end portion 62.

Figure 6:
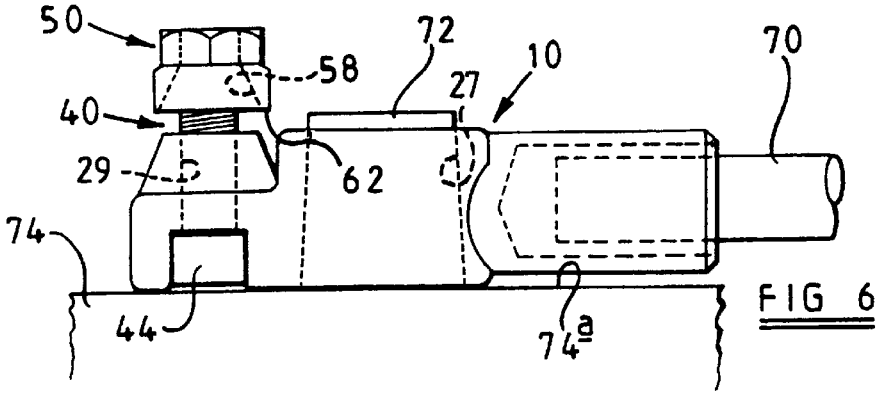
FIG. 6 illustrates a stage in the assembly of the various components.

Referring now to FIG. 6, in use, an electric cable 70 (shown in part) is inserted into the recess in the end region 12 which is then crimped, soldered, welded or otherwise arranged to hold the cable in place and to make electrical contact thereto. The shank 42 of the bolt 40 is inserted through the passage 29 from face 26 of the clamp 10, such that a portion of the screw threaded region 46 of the shank 42 extends beyond face 24 and the cross piece 44 is seated in the locating recess 32. The assembly is then placed on the terminal post 72 of a vehicle battery 74 (shown in part) such that the post 72 is located in passage 27 and the cross piece 44 of the bolt 40 is held in its locating recess 32 by an upper surface 74*a* of the battery 74. The nut 50 is then screwed onto the bolt 40 which is held in its locating recess 32 against counter-rotation. As the nut 50 is tightened, the jaws 14 are drawn closer together, causing the terminal post to be gripped progressively more tightly therebetween.

If removal of the clamping element 10 is required, for example for maintenance or replacement of the battery 74, the above process is reversed. This is a simple procedure even if there is corrosion between surfaces 58 of the nut 50 and 28 of the clamping component 10, since loosening of the nut 50, which is facilitated by the bolt 40 being held in its locating recess 32 against counter-rotation, inevitably results in both axial and rotational movement of the surface 58 relative to the surface 28, thus breaking any binding of the two surfaces and freeing the jaws 14 to spring apart, releasing their grip on the terminal post 72.

It will be understood that while the provision of a cross-piece 44 and corresponding recesses 32 in the jaws is a convenient arrangement to inhibit rotation of the bolt 40, other arrangements for locking a bolt against rotation relative to the jaws are possible, for example the bolt could have a hexagonal head received in corresponding recesses in the jaws. Moreover alternative forms of nut 50 can be used, for example wing nuts or socket headed nuts provided with an appropriate recess 60 could be utilised.

As will be apparent the cam surfaces 28, 58 could be other tapering surfaces of revolution centred on the axis of the bolt shank 42, for example part spherical.

What is claimed is:

1. A terminal clamp for a battery terminal post comprising first and second relatively moveable jaws defining between them a passage for receiving the battery terminal post, and a screw-operated clamping arrangement for closing said first and second jaws about the terminal post, in use, to grip the post against a resilient restoring force urging the jaws apart, said screw-operated clamping arrangement having an axis extending generally parallel to the axis of said passage for receiving the battery terminal post, and said clamping arrangement including first and second components in screw-threaded arrangement with one another, said first component being held against rotation relative to said jaws, said second component having a cam surface cooperable with corresponding cam surfaces of said jaws, said cam surfaces being surfaces of revolution, or parts thereof, centered on the axis of said screw-threaded arrangement whereby rotation of said second component relative to said first component and said jaws causes rotational and axial movement of said cam surface of the second component relative to said cam surfaces of said jaws either to close the jaws or to release the jaws.

2. The terminal clamp as claimed in claim 1, within said cam surfaces are frusto-conical.

3. The terminal clamp as claimed in claim 1, wherein said first component comprises a captive bolt.

4. The terminal clamp as claimed in claim 3, wherein said second component comprises a nut in threaded engagement with the shank of said bolt.

5. The terminal clamp as claimed in claim 1, wherein said jaws are united at one end and carry said cam surfaces adjacent their opposite ends, said post receiving recess being defined intermediate said cam surfaces and said one end.

6. The terminal clamp as claimed in claim 5, wherein a conductive lead is electrically connected to said jaws adjacent their united end.

7. A terminal clamp for a battery terminal post comprising first and second relatively moveable jaws defining between them a first passage for receiving the battery terminal post, the first passage having an axis, said first and second jaws together defining an exterior cam surface spaced apart from the passage, a second passage being defined between the first and second jaws proximate the exterior cam surface and having an axis generally parallel to the axis of the first passage, said terminal clamp further including a screw-operated clamping arrangement configured to engage the exterior cam surface of the jaws to close said first and second jaws about the terminal post, to cause said first and second jaws to move towards one another to grip the post against a resilient restoring force urging the jaws apart, said screw-operated clamping arrangement including a bolt configured to pass through the second passage, and a nut configured for screw-threaded arrangement with the bolt, said nut having an interior cam surface engageable with the exterior cam surface of said jaws, said nut including a threaded aperture having an axis, said cam surface of said nut having an axis coaxial with the axis of the threaded aperture, wherein, in operation, rotation of said nut relative to said bolt in a first direction causes rotational and axial movement of said cam surface of the nut relative to said cam surfaces of said jaws to close the jaws and rotation of said nut relative to said bolt in a second direction, opposite the first direction, causes rotational and axial movement of said cam surface of the nut relative to said cam surfaces of said jaws to release the jaws.

* * * * *